United States Patent [19]

Alley

[11] 4,212,394

[45] Jul. 15, 1980

[54] EDGE AND CORNER CUSHION FOR PALLETIZED PACKAGES AND THE LIKE

[76] Inventor: Donald E. Alley, 5440 Hillside Ter., Milford, Ohio 45150

[21] Appl. No.: 41,241

[22] Filed: May 21, 1979

[51] Int. Cl.[2] ..... B65D 5/60; B65D 5/50; B65D 25/12

[52] U.S. Cl. ..... 206/586; 229/34 R; 229/DIG. 1

[58] Field of Search ..... 206/586, 386, 600, 322; 229/34 R, 34 HW, 31 I, DIG. 1, DIG. 11

[56] References Cited

U.S. PATENT DOCUMENTS

| | | | |
|---|---|---|---|
| 2,514,833 | 7/1950 | Bergeron | 206/586 |
| 2,893,621 | 7/1959 | Harnish et al. | 229/34 R |
| 2,997,222 | 8/1961 | Sperry | 229/34 R |
| 3,162,350 | 12/1964 | Miller | 229/31 I |
| 3,220,683 | 11/1965 | Doll | 206/586 |

*Primary Examiner*—William T. Dixson, Jr.

*Attorney, Agent, or Firm*—Wood, Herron & Evans

[57] ABSTRACT

A die-cut and scored blank fabricated from corrugated paperboard or other type of stock material is erected into a cushion for covering an edge and at least one contiguous corner of a package such as a carton or crate. When positioned on the package, the cushion provides protection from binding straps used in palletizing and protects against damage due to impact during moving, handling and storing. The cushion also serves as a brace between packages when packages are vertically stacked. In one embodiment, a blank is provided which is foldable to form a cushion having three cushioning walls for protecting an edge and one contiguous corner of a package. Furthermore, a modified blank is provided which is foldable to form a cushion having four cushioning walls for protecting an edge and both contiguous corners. In both instances, the folded blank is self-locking, thereby remaining erected after folding to facilitate positioning the cushion on the package.

12 Claims, 8 Drawing Figures

EDGE AND CORNER CUSHION FOR PALLETIZED PACKAGES AND THE LIKE

BACKGROUND OF THE INVENTION

This invention relates to the field of packaging. More particularly, it relates to protecting edges and corners of cartons, crates, boxes and like packages against damage, especially when such packages are palletized.

Cartons and crates are frequently banded to pallets by means of metal or plastic binding straps because palletized packages are easier to move, handle and store, for example, during shipment. However, the binding straps tend to dig into and damage the edges and corners of the packages. It is desirable to avoid damage caused by the binding straps.

Packages, and especially the package edges and corners, are also susceptible to being struck and damaged during transit or storage. It is desirable to protect the edges and corners of packages from damage due to contact with other objects or due to impact during moving, handling and storing.

Furthermore, packages are frequently vertically stacked during storage. The weight on the bottom package can be considerable. The weight tends to collapse the package. It is desirable to prevent a package from being crushed when packages are vertically stacked.

Various cushions are known for protecting edges and/or corners of packages. Many known cushions are fabricated from corrugated paperboard blanks which are die-cut and scored and erected into a cushion. Preferably, the cushion remains erected once the blank is folded to facilitate positioning the cushion on a package.

Various approaches are known for retaining the cushion in an erected condition. Glue has been used as shown in Schario, U.S. Reissue Pat. No. 19,121. White, U.S. Pat. No. 2,196,157, discloses the use of adhesive tape to retain the cushion in an erected condition. A staple has been used as shown in Kirby, U.S. Pat. No. 2,271,265 (FIG. 6). However, there are several disadvantages to the use of glue, adhesive tape, staples and the like, for retaining the cushion in an erected condition. A supply of glue, adhesive tape, staples, etc., must be maintained, and the use of such materials adds to the unit cost of each cushion. Furthermore, additional time is required to assemble each cushion in applying glue, affixing adhesive tape, stapling or the like, which adds to the labor cost. Perhaps the primary disadvantage is that such cushions must usually be assembled and shipped in the erected condition which adds to shipping costs.

Kirby, U.S. Pat. No. 2,271,265, Anderson, U.S. Pat. No. 2,509,468, and Redler, British Pat. No. 1,327,463, are exemplary of an approach for retaining a cushion in an erected condition which does not have the foregoing disadvantages. The Kirby patent discloses a substantially rectangular corrugated paperboard blank with an interfitting tongue and notch which lock the cushion in the erected condition once the blank is folded. The Anderson patent discloses an edge and corner cushion which is also fabricated from a corrugated paperboard blank. The blank includes a tongue and recess that interfit for locking the cushion in the erected condition. The Redler patent discloses a corrugated paperboard blank having cooperating locking tabs and slots which lock the cushion in the erected condition once the blank is folded. The cushions erected from the self-locking blanks disclosed in those patents nevertheless have several apparent disadvantages. There is a relatively large amount of waste produced when each of the disclosed blanks is die-cut from stock material. Furthermore, the cushions do not provide maximum bracing between packages when packages are vertically stacked during storage.

It is one objective of this invention to provide an improved edge and corner cushion formed from a die-cut and scored blank fabricated from corrugated paperboard or other type of stock material such that the blank is easily folded and is self-locking, thereby remaining erected after folding without the use of glue, adhesive tape, staples, or the like.

Another objective is to provide an edge and corner cushion formed from a blank which is configured so that there is a minimum of waste when the blank is die-cut from stock material.

A further objective is to provide an edge and corner cushion formed from a blank which is configured so as to be nestable with other blanks in order to minimize waste when the blanks are die-cut from stock material.

An additional objective is to provide an edge and corner cushion which gives improved bracing between packages when packages are vertically stacked during storage.

Another objective is to provide a cushion which is economical to manufacture and easy to erect and position on a package for protecting an edge and at least one contiguous corner of a package and which serves as a brace between vertically stacked packages during storage.

SUMMARY OF THE INVENTION

In accordance with this invention, an improved edge and corner cushion comprises a generally rectangular blank die-cut from corrugated paperboard or other type of stock material which is scored for easy folding and is self-locking so that the cushion remains erected after the blank is folded to facilitate positioning the cushion on a package. The blank is scored to form folding panels. Locking tabs and notches are provided along the edges of the blank for locking the panels in a fixed position after the blank is folded.

In one embodiment, a blank is provided which is foldable to form a cushion having three cushioning walls for protecting an edge and one contiguous corner of a package. Furthermore, a modified blank is provided which is foldable to form a cushion having four cushioning walls for protecting an edge and both contiguous corners. In both instances, the folded blank is self-locking, thereby remaining erected after folding to facilitate positioning the cushion on the package.

DETAILED DESCRIPTION OF THE INVENTION

Figure 1:
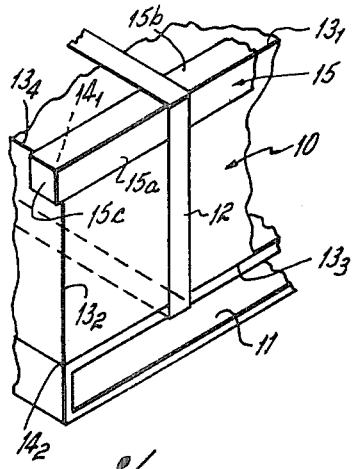
FIG. 1 is a fragmentary perspective view illustrating an edge and corner cushion in accordance with this invention associated with a palletized package.

A purpose of the cushion provided by this invention is protecting the edges and corners of a package, especially a palletized package, as shown in FIG. 1. In FIG. 1, the package 10 is banded to a pallet, or skid, 11 by means of at least one binding strap 12. The package has edges, such as indicated by the numerals $13_1$, $13_2$, $13_3$ and $13_4$, and corners, such as indicated by the numerals $14_1$ and $14_2$. An edge and corner cushion 15 in accordance with this invention is provided between the package and binding strap 12 for preventing the binding strap from biting into edge $13_1$ of the package as well as for protecting against damage to the package due to an impact on edge $13_1$ or corner $14_1$.

Figure 1A:
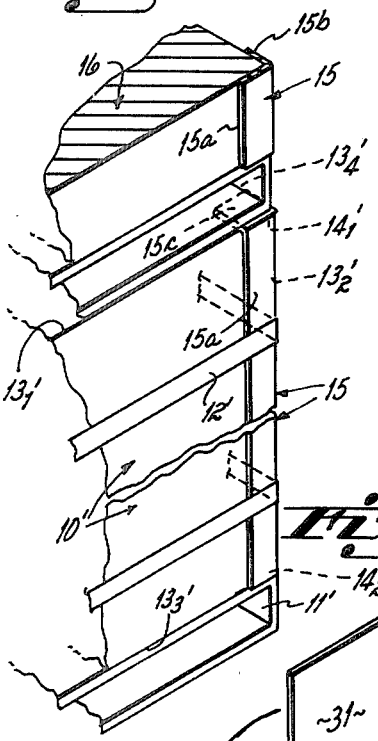
FIG. 1*a* is a similar view illustrating an edge and corner cushion in accordance with this invention associated with a package for vertical stacking during storage.

Another purpose of the cushion provided by this invention is serving as a brace between vertically stacked packages during storage. FIG. 1*a* shows an edge and corner cushion 15 interposed between a package 10' and binding straps 12' for preventing the binding straps from biting into edge $13_2'$ of the package as well as for protecting against damage to the package if the package were struck on edge $13_2'$ or corner $14_1'$. The edge and corner cushion 15 in FIG. 1*a* also provides vertical support for a package 16 stacked on top of package 10' during storage.

Figure 2:
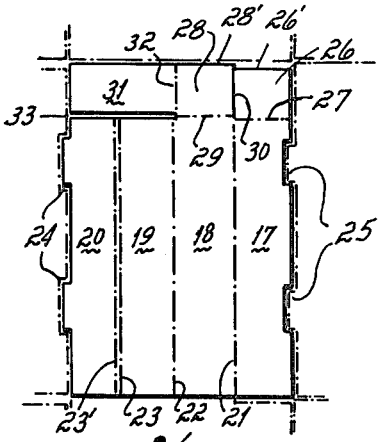
FIG. 2 shows a blank in accordance with this invention for forming a cushion having three cushioning walls for protecting an edge and one contiguous corner of a package.

FIG. 2 illustrates a substantially rectangular blank in accordance with one embodiment of this invention which is erected into a cushion including three cushioning walls for protecting an edge and one contiguous corner of a package. The blank is preferably die-cut from corrugated paperboard or other type of stock material suitable for folding.

The blank includes a first panel 17, a second panel 18, a third panel 19 and a fourth panel 20 which lie parallel to each other. Panel 17 is attached to panel 18 along a first score line 21. Panels 18 and 19 are attached along a second score line 22. Panel 19 is attached to panel 20 along at least one score line, that is, a third score line 23. Preferably, a double score line comprising score line 23 and a score line 23' separate panels 19 and 20 as shown in FIG. 2. Score lines 23 and 23' are spaced apart a distance equal to twice the thickness of the stock material from which the blank is die-cut, thereby facilitating the final fold shown in FIG. 4 described later. Panel 20 includes at least one locking tab 24, and panel 17 includes at least one corresponding notch 25 which, when the blank is folded, interlock and cause the blank to remain folded.

Figure 4:
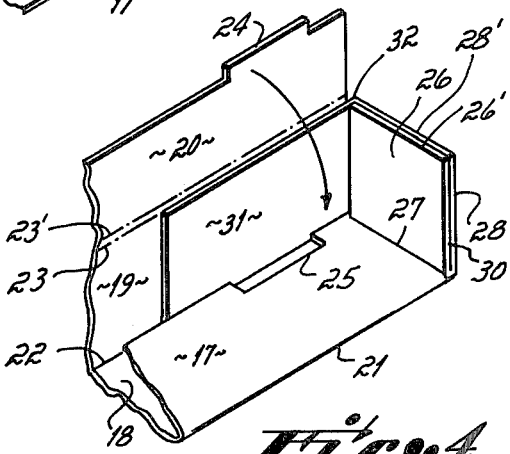
FIG. 4 is a view of the blank in FIG. 2 with the final fold indicated by an arrow.
Figure 5:
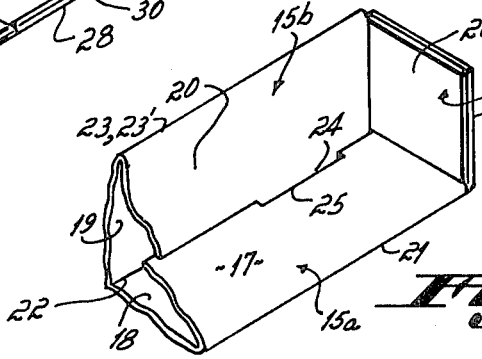
FIG. 5 is a view of one end of the edge and corner cushion erected from the blank in FIG. 2.

A fifth panel 26 is attached to panel 17 along a fourth score line 27, and a sixth panel 28 is attached to panel 18 along a fifth score line 29. Panels 26 and 28 are separated from each other by a cut 30. Panel 26 is preferably slightly shorter than panel 28 by an amount equal to the thickness of the stock material so that the end 26' of panel 26 is even with the end 28' of panel 28 when the blank is folded as shown in FIG. 5. A seventh panel 31 is attached to panel 28 along a sixth score line 32 and is separated from panels 19 and 20 by a slender cutout 33. Cutout 33 preferably has a width equal to twice the thickness of the stock material to facilitate folding as shown in FIG. 4.

Preferably, if score line 27 were extended to the left as viewed in FIG. 2, it would coincide with the lower edge of cutout 33 and would be spaced below score line 29 a distance equal to one thickness of the stock material. Score line 29 preferably intersects the end of cutout 33 equidistant between the upper and lower edges of the cutout. Finally, if score line 32 were extended downwardly as viewed in FIG. 2, preferably it would coincide with the end of cutout 33 and would be spaced to the right of score line 22 a distance equal to one-half the thickness of the stock material. As a result, folding is facilitated.

Figure 3:
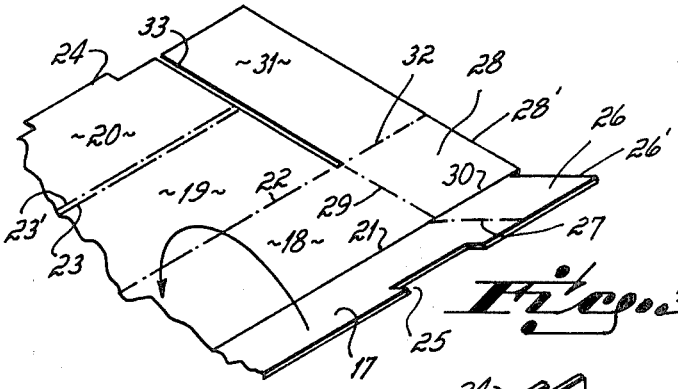
FIGS. 3 and 3*a* illustrate various stages of folding the blank in FIG. 2.
Figure 3A:
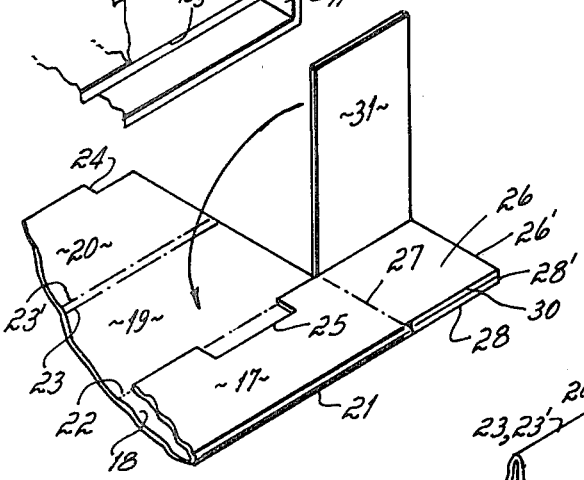

In order to erect an edge and corner cushion from the blank in FIG. 2, panels 17 and 26 are folded upwardly and inwardly along score line 21 and cut 30 onto panels 18 and 28 as indicated by the arrow in FIG. 3. Next, panels 26, 28 and 31 are folded upwardly along score lines 27 and 29 and cutout 33 out of the plane of the blank to a position perpendicular to the other panels, while panel 31 is folded inwardly along score line 32 until it lies along score line 22 as shown in FIG. 3*a*. Finally, panels 19 and 20 are folded upwardly and over panel 31 along score lines 22 and 23 (See Fig. 4). Locking tabs 24 frictionally engage with notches 25 along score line 22 and secure the blank in a folded position as shown in FIG. 5.

The blank in FIG. 2 forms a cushion comprising three protective walls as shown in FIGS. 1, 1*a* and 5. The walls are indicated by the numerals **15*a*, 15*b* and 15*c*** and comprise a double layer of stock material for protecting at least one edge and a contiguous corner of a package as well as serving as a brace between vertically stacked packages.

Figure 6:
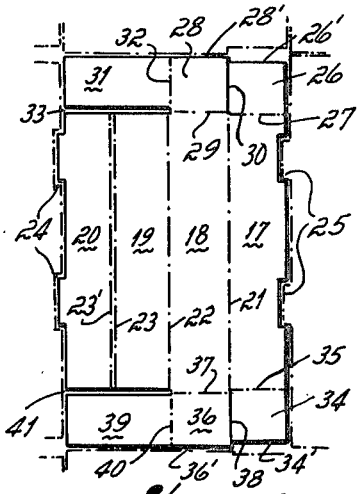
FIG. 6 shows a modified blank for forming a cushion having four cushioning walls for protecting an edge and both contiguous corners of a package.

FIG. 6 illustrates a modified blank which is erected into a cushion including four cushioning walls for protecting an edge and both contiguous corners of a package. The blank is preferably die-cut from corrugated paperboard or other type of stock material suitable for folding.

The blank shown in FIG. 6 is a modified version of the blank in FIG. 2. The blank in FIG. 6 is the same as shown in FIG. 2 except that an eighth panel 34 is attached to panel 17 along a seventh score line 35, and a ninth panel 36 is attached to panel 18 along an eighth score line 37. Panels 34 and 36 are separated from each other by a cut 38. Panel 34 is preferably slightly shorter than panel 36 by an amount equal to the thickness of the stock material so that the end 34' of panel 34 is even with the end 36' of panel 36 when the blank is folded. A tenth panel 39 is attached to panel 36 along a ninth score line 40 and is separated from panels 19 and 20 by a slender cutout 41. Cutout 41 preferably has a width equal to twice the thickness of the stock material to facilitate folding.

Preferably, if score line 35 were extended to the left as viewed in FIG. 6, it would coincide with the upper edge of cutout 41 and would be spaced above score line 37 a distance equal to one thickness of the stock material. Score line 37 preferably intersects the end of cutout 41 equidistant between the upper and lower edges of the cutout. Finally, if score line 40 were extended upwardly as viewed in FIG. 6, preferably it would coincide with the end of cutout 41 and would be spaced to the right of score line 22 a distance equal to one-half the thickness of the stock material. As a result, folding is facilitated.

As shown in FIG. 6, the portion of the blank formed by panels 34, 36 and 39 is a mirror image of the portion of the blank formed by panels 26, 28 and 31. Score lines 35, 37 and 40 also form a mirror image of score lines 27, 29 and 32, while cut 38 forms a mirror image of cut 30 and cutout 41 forms a mirror image of cutout 33. Panels 34, 36 and 39 are simultaneously folded in a way analogous to the way that panels 26, 28 and 31 are folded described earlier in connection with FIGS. 3–3*a*. Panels 19 and 20 are then folded upwardly and over panels 31 and 39 simultaneously so that locking tabs 24 engage in notches 25. As a result, a mirror image of wall 15*c* is formed opposite the wall 15*c* for protecting an edge and both contiguous corners of a package.

As shown in FIGS. 2 and 6, the blanks are configured so that they may be nested in order to minimize the amount of stock material that is wasted when the blanks are die-cut. Only the stock material trimmed from the end of panel 26 and cutout 33 of the blank in FIG. 2 is discarded. The stock material trimmed from the end of panels 26 and 34 and cutouts 33 and 41 is discarded when the blank in FIG. 6 is die-cut.

Each of the blanks in FIGS. 2 and 6 is configured so that cushioning walls having a double thickness of stock material are provided when the panels are folded to form an edge and corner cushion. The double-thickness of the cushion provides excellent protection against damage to the edges and corners of a package from binding straps or impact. Each blank is also configured so that a cushion of superior rigidity is provided when the panels are folded. The rigid cushion provides an effective brace between vertically stacked packages during storage. Yet the score lines of each blank are arranged so that the panels are easily folded to form a cushion. Locking tabs and notches are associated with the panels so that the blank is self-locking, thereby remaining erected after folding to facilitate positioning the cushion on a package.

Each of the blanks in FIGS. 2 and 6 is also economical to manufacture. Each blank is configured so that there is a minimum of waste when the blank is die-cut from stock material. The waste is kept at a minimum since each blank is configured to be nestable when die-cut from stock material.

The edge and corner cushions erected from the blanks in FIGS. 2 and 6 are particularly advantageous when used in palletized packages as shown in FIGS. 1 and 1*a*. Furthermore, the cushions are also advantageous when applied to the edges and corners of an article before the article is placed inside a carton. When the article is placed inside the carton, the cushions cover the edges and corners of the article as well as space the faces of the article away from the walls of the carton, thereby protecting against damage to the article caused by impact transmitted through the carton or caused by binding straps used in tying or palletizing the carton. The cushions also provide a vertical brace, thereby preventing the article from being crushed when cartons are stacked one atop another.

Various embodiments and uses of the edge and corner cushion of this invention have been described by way of example. It will be understood by those skilled in the art that various modifications could be made without departing from the spirit and scope of the invention as defined by the appended claims.

I claim:

1. An edge and corner cushion comprising a generally rectangular blank fabricated from corrugated paperboard or other type of stock material, said blank including a plurality of score lines defining panels which are folded along said score lines for forming said cushion, said blank including first, second, third, fourth, fifth and sixth score lines; a first panel being bordered by said first score line, a first edge of said blank, a second edge of said blank and said fourth score line; a second panel adjoining said first panel along said first score line, said second panel being bordered by said first score line, said first edge of said blank, said second score line and said fifth score line; a third panel adjoining said second panel along said second score line, said third panel being bordered by said second score line, said first edge of said blank, said third score line and a first cutout; a fourth panel adjoining said third panel along said third score line, said fourth panel being bordered by said third score line, said first edge of said blank, a third edge of said blank and said first cutout; a fifth panel adjoining said first panel along said fourth score line, said fifth panel bordered by said fourth score line, said second edge of said blank, a fourth edge of said blank and a first cut; a sixth panel adjoining said second panel along said fifth score line, said sixth panel being bordered by said fifth score line, said first cut, said fourth edge of said blank and said sixth score line; and a seventh panel adjoining said sixth panel along said sixth score line, said seventh panel being bordered by said sixth score line, said fourth edge of said blank, said third edge of said blank and said first cutout; said first panel being foldable along said first score line so that said first and fifth panels respectively overlap said second and sixth panels; said fifth and sixth panels being foldable along said respective fourth and fifth score lines so that said overlapping fifth and sixth panels are substantially perpendicular to said overlapping first and second panels; said seventh panel being foldable along said sixth score line so that said seventh panel is substantially perpendicular to said overlapping first and second panels and said overlapping fifth and sixth panels, the border of said seventh panel defined by said first cutout lying substantially parallel to said second score line; said third panel being foldable along said second score line so that said third panel overlaps said seventh panel; and said fourth panel being foldable along said third score line so that said fourth panel overlaps said overlapping third and seventh panels; the border of said first panel defined by said second edge of said blank and the border of said fourth panel defined by said third edge of said blank having cooperating locking means for retaining said blank erected into said cushion once said panels are folded, said erected cushion for protecting an edge and at least one contiguous corner of a package against damage from binding straps or impact and for providing a brace between vertically stacked packages.

2. The cushion of claim 1 wherein said blank further includes seventh, eighth and ninth score lines; wherein said first panel is bordered by said first score line, said seventh score line, said second edge of said blank and said fourth score line; wherein said second panel is bordered by said first, second, fifth and eighth score lines; wherein said third panel is bordered by said second score line, said first cutout, said third score line and a second cutout; and wherein said fourth panel is bordered by said third score line, said first cutout, said third edge of said blank and said second cutout; an eighth panel adjoining said first panel along said seventh score line, said eighth panel being bordered by said seventh score line, a second cut, said first edge of said blank and said second edge of said blank; a ninth panel adjoining said second panel along said eighth score line, said ninth panel being bordered by said eighth score line, said ninth score line, said first edge of said blank and said second cut; and a tenth panel adjoining said ninth panel along said ninth score line, said tenth panel being bordered by said ninth score line, said second cutout, said first edge of said blank and said third edge of said blank; said first panel being foldable along said first score line so that said first, fifth and eighth panels respectively overlap said second, sixth and ninth panels; said fifth and sixth panels being foldable along said respective fourth and fifth score lines and said eighth and ninth panels being foldable along said respective seventh and eighth score lines so that said overlapping fifth and sixth panels and said overlapping eighth and ninth panels are substantially perpendicular to said overlapping first and second panels, said overlapping fifth and sixth panels facing said overlapping eighth and ninth panels; said seventh panel being foldable along said sixth score line and said tenth panel being foldable along said ninth score line so that said seventh and tenth panels are substantially perpendicular to said overlapping first and second panels, said overlapping fifth and sixth panels and said overlapping eighth and ninth panels, the border of said seventh panel defined by said first cutout and the border of said tenth panel defined by said second cutout lying substantially parallel to said second score line; said third panel being foldable along said second score line so that said third panel overlaps said seventh and tenth panels; and said fourth panel being foldable along said third score line so that said fourth panel overlaps said overlapping third and seventh panels and said overlapping third and tenth panels; the border of said first panel defined by said second edge of said blank and the border of said fourth panel defined by said third edge of said blank having cooperating locking means for retaining said blank erected into said cushion once said panels are folded, said erected cushion for protecting an edge and both contiguous corners of a package against damage from binding straps or impact and for providing a brace between vertically stacked packages.

3. The cushion of claim 1 or 2 wherein said cooperating locking means comprises at least one notch formed in said blank along the border of said first panel defined by said second edge of said blank and at least one locking tab formed in said blank along the border of said fourth panel defined by said third edge of said blank, said locking tabs engaging in said notches when said panels are folded for retaining said blank erected into said cushion.

4. The cushion of claim 1 or 2 wherein said third score line is a double score line including one score line separated from the other score line by a distance equal to twice the thickness of the corrugated paperboard or other type of stock material from which said blank is fabricated, thereby facilitating folding said panels.

5. The cushion of claim 1 or 2 wherein each said cutout has a width equal to twice the thickness of the corrugated paperboard or other type of stock material from which said blank is fabricated, thereby facilitating folding said panels.

6. The cushion of claim 1 wherein said fifth panel is foreshortened along the border defined by said fourth edge of said blank in an amount equal to the thickness of the corrugated paperboard or other type of stock material from which said blank is fabricated.

7. The cushion of claim 2 wherein said fifth panel is foreshortened along the border defined by said fourth edge of said blank and said eighth panel is foreshortened along the border defined by said first edge of said blank in an amount equal to the thickness of the corrugated paperboard or other type of stock material from which said blank is fabricated.

8. The cushion of claim 1 wherein the distance between the borders of said first panel defined by said first edge of said blank and said fourth score line is less than the distance between the borders of said second panel defined by said first edge of said blank and said fifth score line in an amount equal to the thickness of the corrugated paperboard or other type of stock material from which said blank is fabricated, thereby facilitating folding said panels.

9. The cushion of claim 2 wherein the distance between the borders of said first panel defined by said fourth and seventh score lines is less than the distance between the borders of said second panel defined by said fifth and eighth score lines in an amount equal to twice the thickness of the corrugated paperboard or other type of stock material from which said blank is fabricated, thereby facilitating folding said panels.

10. The cushion of claim 1 wherein the distance between said sixth score line and said second edge of said blank is less than the distance between said second score line and said second edge of said blank in an amount equal to one-half the thickness of the corrugated paperboard or other type of stock material from which said blank is fabricated, thereby facilitating folding said panels.

11. The cushion of claim 2 wherein the distance between said sixth score line and said second edge of said blank is less than the distance between said second score line and said second edge of said blank and the distance between said ninth score line and said second edge of said blank is less than the distance between said second score line and said second edge of said blank in an amount equal to one-half the thickness of the corrugated paperboard or other type of stock material from which said blank is fabricated, thereby facilitating folding said panels.

12. The cushion of claim 1 or 2 wherein said blank is configured for nesting with at least one other blank when said blanks are die-cut from corrugated paperboard or other type of stock material, thereby minimizing waste.

* * * * *